US009212015B2

(12) United States Patent
Arakane

(10) Patent No.: US 9,212,015 B2
(45) Date of Patent: Dec. 15, 2015

(54) FEEDING APPARATUS

(75) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 246 days.

(21) Appl. No.: 13/431,823

(22) Filed: Mar. 27, 2012

(65) Prior Publication Data

US 2012/0286466 A1 Nov. 15, 2012

(30) Foreign Application Priority Data

May 13, 2011 (JP) ..... 2011-108160

(51) Int. Cl.
*B65H 7/02* (2006.01)
*B65H 3/06* (2006.01)
*B65H 7/06* (2006.01)

(52) U.S. Cl.
CPC ..... *B65H 3/0684* (2013.01); *B65H 7/06* (2013.01); *B65H 2402/441* (2013.01); *B65H 2402/46* (2013.01); *B65H 2404/6111* (2013.01); *B65H 2405/3322* (2013.01); *B65H 2511/33* (2013.01); *B65H 2511/417* (2013.01); *B65H 2511/514* (2013.01); *B65H 2513/511* (2013.01); *B65H 2551/20* (2013.01); *B65H 2701/1311* (2013.01); *B65H 2801/06* (2013.01)

(58) Field of Classification Search
CPC ..... B65H 7/00; B65H 7/02; B65H 7/04; B65H 7/06; B65H 7/18; B65H 43/01; B65H 2511/52; B65H 2511/515; B65H 2511/528; B65H 2511/529
USPC ..... 271/10.02, 10.03, 265.01, 258.01, 259; 399/16, 21
See application file for complete search history.

(56) References Cited

U.S. PATENT DOCUMENTS 8,262,079 B2 * 9/2012 Uchino ..... 271/10.03
2010/0207321 A1 * 8/2010 Samoto et al. ..... 271/225

FOREIGN PATENT DOCUMENTS

JP H11-334935 A 12/1999
JP 2000-191158 A 7/2000
JP 2003-192188 A 7/2003

* cited by examiner

*Primary Examiner* — Thomas Morrison
(74) *Attorney, Agent, or Firm* — Baker Botts L.L.P.

(57) ABSTRACT

A feeding apparatus includes a feeding device that feeds paper from a tray to a feed path, a guide member that moves between a first position to cover the feed path and a second position to expose the feed path, a detection device disposed along the feed path downstream from the guide member, and detects the paper fed in the feed path, a judgment device that judges whether a feeding error has occurred in the feed path, a particular information control device that stores particular information in a memory when a feeding error has occurred, and a notification device that issues information indicating that the paper has not been fed from the tray to the feed path when the paper is not detected by the detection device and the memory does not store the particular information.

11 Claims, 8 Drawing Sheets

FEEDING APPARATUS

CROSS-REFERENCE TO RELATED APPLICATION

This application claims priority from Japanese Patent Application No. 2011-108160, filed on May 13, 2011, which is incorporated herein by reference.

BACKGROUND OF THE INVENTION

1. Field of the Invention

The present invention relates generally to a feeding apparatus configured to feed a sheet through a feed path.

2. Description of Related Art

A known feeding apparatus feeds a sheet through a feed path formed therein. The known feeding apparatus may be an image forming apparatus, e.g., a printer, that records an image on a sheet. A known image forming apparatus is provided with a cover that selectively covers and exposes the feed path, such that a sheet stuck in the feed path may be removed. The known image forming apparatus has a manual paper feed tray as a cover that switches between a storage state, in which the manual paper feed tray is closed, and a paper jam processing state, in which the manual paper feed tray is open. The cover is closed in the storage state and guides a sheet fed through the feed path. On the other hand, the cover is open in the jam processing state, and the feed path and a sheet stuck in the feed path are exposed to the exterior of the known image forming apparatus.

If a sheet fed through the feed path is stuck in the image forming apparatus, a user switches the cover from the storage state to the jam processing state. Thus, the cover is opened and the feed path and the sheet stuck in the feed path are exposed. The user may grasp and remove the sheet stuck inside the image forming apparatus.

SUMMARY OF THE INVENTION

The known image forming apparatus may detect the presence of a sheet fed from a tray, in which the sheet has been stored, through the feed path using a sensor provided along the feed path downstream of the cover in the feed direction. When a sheet is not detected by the sensor within a certain amount of time after feeding the sheet from the tray, a control unit of the image forming apparatus judges that there may be no sheets in the tray. The control unit causes a display unit provided in the known image forming apparatus to indicate that no sheets are stored in the tray.

When the user forgets to close the cover after opening the cover to remove a sheet stuck in the feed path from the image forming apparatus and a start key on the image forming apparatus is pressed while the cover remains open, feeding of a sheet from the tray begins.

When a sheet is fed from the tray through the feed path while the cover remains open, the sheet is not guided by the cover. Thus, the sheet comes out of the image forming apparatus from a portion of the image forming apparatus at which the cover is provided. Therefore, the sheet is not fed to the downstream side of the cover in the feed direction, and is not detected by the sensor. Accordingly, the control unit of the known image forming apparatus incorrectly judges that there are no sheets in the tray and issues information indicating that there are no sheets in the tray, although a sheet has been fed from the tray.

The present invention may provide a feeding apparatus configured to notify the user of appropriate measures when a sheet is not detected by the sensor within a certain amount time after the sheet is fed from the tray.

According to an embodiment of invention, a feeding apparatus comprising: a tray configured to store a recording medium; a feeding device configured feed the recording medium from the tray to a feed path; a guide member disposed along the feed path and configured to selectively move between a first position, in which the guide member exposes the feed path, and a second position, in which the guide member covers the feed path and guides the recording medium through the feed path; a first detection device disposed along the feed path downstream from the guide member, and configured to detect the recording medium fed in the feed path; a second detection device configured to detect an amount of feeding implemented by the feeding device; a judgment device configured to judge whether a feeding error has occurred in the feed path; a memory configured to store particular information; a particular information control device configured to store the particular information in the memory when the judgment device judges that a feeding error has occurred in the feed path, and configured to delete the particular information from the memory when the recording medium is detected by the first detection device; and a notification device configured to: issue information indicating that the recording medium has not been fed from the tray to the feed path when the recording medium is not detected by the first detection device before the amount of feeding of the feeding device, which is detected by the second detection device since the recording medium begins to be fed, reaches a predetermined amount of feeding, and when the memory does not store the particular information, and issue information indicating that the guide member is in the first position when the recording medium is not detected by the first detection device before the amount of feeding of the feeding device, which is detected by the second detection device since the recording medium begins to be fed, reaches a predetermined amount of feeding, and when the memory stores the particular information.

When it is likely that the user forgot to close the first guide member, the notification unit may notify the user that the first guide member remains open. On the other hand, when it is unlikely that the user has opened the first guide member, the notification unit may notify the user that a sheet has not been appropriately fed. Therefore, when a sheet is not detected by the sensor within the certain amount of feeding after the sheet is fed from the tray, the user may be notified of appropriate measures.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DESCRIPTION OF EMBODIMENTS OF THE INVENTION

Figure 1:
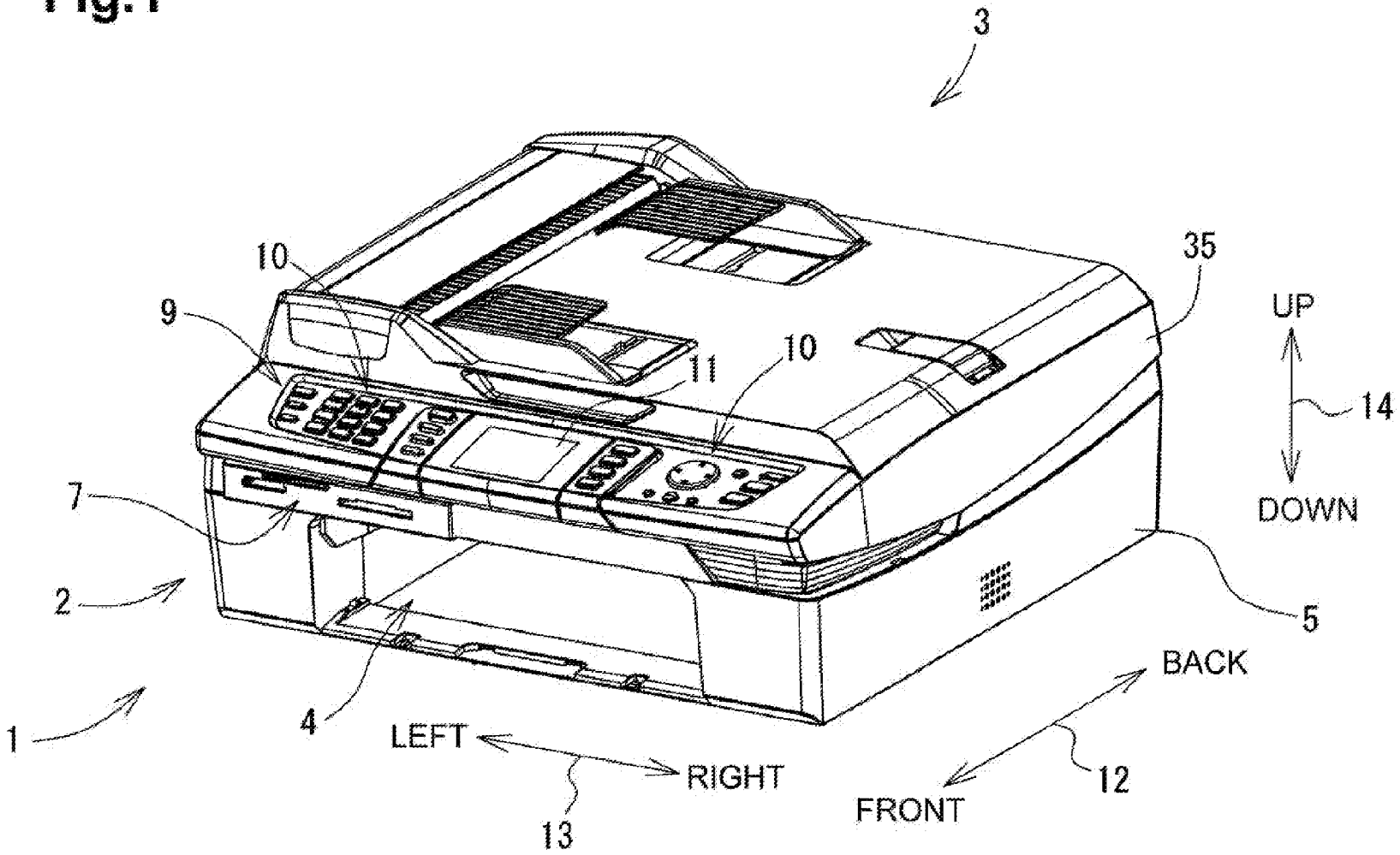
FIG. 1 is an external perspective view of a multifunction device according to an embodiment of the invention.

Embodiments of the invention now are described in detail with reference to the accompanying drawings; like reference numerals are used for like corresponding parts in the various drawings.

As depicted in FIG. 1, an up-down direction 14 may be defined with reference to an upright orientation in which a multifunction device 1 is intended to be used. A side of the multifunction device 1, where an operation panel 9 is provided, may be defined as the front of the multifunction device 1. A front-back direction 12 may be defined with reference to the front of the multifunction device 1. A right-left direction 13 may be defined with respect to the multifunction device 1 as viewed from its front.

Configuration of Multi-Function Device

The multifunction device 1 may be a multi-functional device which may comprise a printing unit 2 and a scanner unit 3 that is disposed above the printing unit 2. The multifunction device 1 may perform, for example, a printer function, a scanner function, a copier function and a facsimile function. The printer function of the multifunction device 1 may perform single-side image recording or double-sided image recording.

Figure 2:
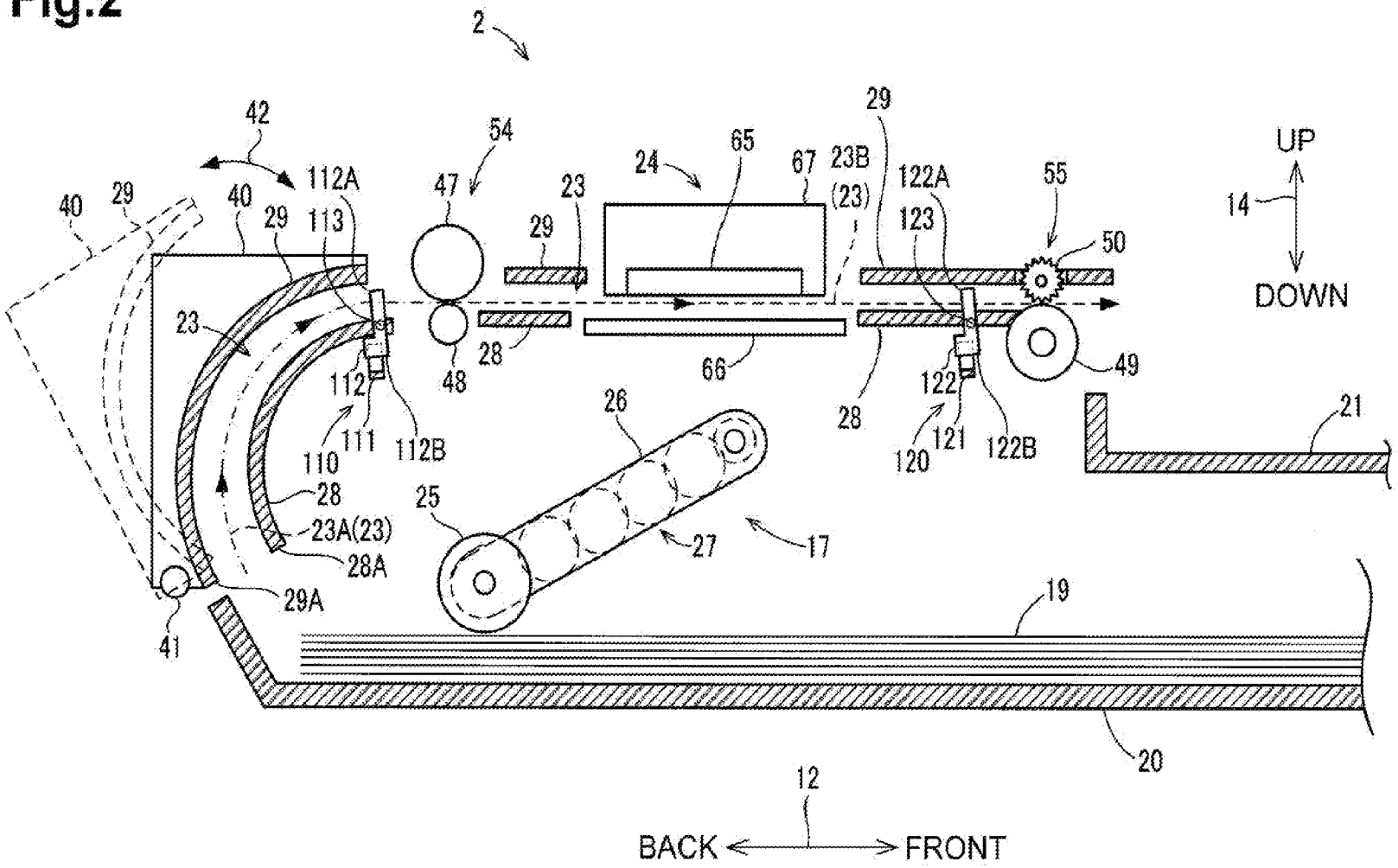
FIG. 2 is a vertical, cross-sectional view depicting the inner configuration of a printing unit according to an embodiment of the invention.

The printing unit 2 may comprise a casing 5 with an opening 4 formed in the front of the casing 5. Components of the printing unit 2 may be disposed in the casing 5. As depicted in FIG. 2, the printing unit 2 may comprise a feed path 23, a paper feed tray 20, a paper discharge tray 21, a paper feed unit 17, a sheet detection unit 110, an outer guide member 29, an inner guide member 28, a back cover 40, and a recording unit 24.

The scanner unit 3 may comprise a body cover 35 that may be opened and closed relative to the printing unit 2. In the body cover 35, a platen glass, on which a document may be set, an image sensor that reads a document set on the platen glass, and the like may be provided. The body cover 35 may be pivotally connected to the printing unit 2 at the back side of the multifunction device 1. The body cover 35 may be opened and closed relative to the printing unit 2 by turning about a pivoting axis on the back side of the multifunction device 1.

The operation panel 9 may be disposed between the upper front side of a top surface of the multifunction device 1 and a front-side top surface of the scanner unit 3. The printing unit 2 and the scanner unit 3 may be operated by operating the operation panel 9. The operation panel 9 may include various operation buttons 10 and a liquid crystal display unit 11. The liquid crystal display unit 11 may be a touch panel. Messages may be displayed on the liquid crystal display unit 11.

The multifunction device 1 may be connected to an external information equipment, e.g., a personal computer, via, for example, a Local Area Network ("LAN"). An input unit, e.g., a keyboard or a mouse, may be provided in the external information equipment. Image data may be stored in a storage unit, e.g., a hard disk or the like, provided in the external information equipment. A command to record image data onto a recording sheet 19 may be sent to a microcomputer 130 together with the image data. The microcomputer 130 may control an operation of the multifunctional device 1 based on the command sent from the external information equipment.

When a start button, which may be one of operation buttons 10 included in an operation panel 9, is pressed while a document is set in the scanner unit 3 or while a memory card is inserted into a slot 7 provided in a front surface of the multifunction device 1, the microcomputer 130 may begin a process in which image data obtained by reading the image of the document or the image data stored in the memory card may be recorded on the recording sheet 19. Thus, the multifunction device 1 may be operated by the microcomputer 130 based on a command from the operation panel 9 or an external information device.

The multifunction device 1 may comprise a feeding apparatus. The feeding apparatus may comprise the feed path 23, the paper feed tray 20, the paper feed unit 17, the sheet detection unit 110, the outer guide member 29, the inner guide member 28, the back cover 40, an electrically erasable programmable read-only memory (EEPROM) 134, and the microcomputer 130.

Paper Feed Tray and Paper Discharge Tray

Referring to FIG. 2, the paper feed tray 20 selectively may attach to and detach from the multifunction device 1 through the opening 4. When attached to the printing unit 2, the paper feed tray 20 may be disposed below the recording unit 24. The paper feed tray 20 may have a substantially rectangular box shape extending in a front-back direction 12, e.g., a direction in which the paper feed tray 20 selectively attaches to and detaches from the multifunction device 1. The recording sheets 19 of desired size, e.g., DIN A4 and JIS B5, may be received in the paper feed tray 20. When the paper feed tray 20 is attached to the printing unit 2, the recording sheets 19 received in the paper feed tray 20 may be fed to the feed path 23 of the printing unit 2

The recording sheet 19 may be output on a top surface of the paper discharge tray 21 after an image is recorded on the recording sheet 19 by the recording unit 24. The paper discharge tray 21 may receive the recording sheet 19 output from the printing unit 2. The paper discharge tray 21 may be disposed above the paper feed tray 20.

Paper Feeding Unit

The paper feeding unit 17 may be disposed above the paper feed tray 20. The paper feeding unit 17 may comprise a paper feed roller 25, a paper feed arm 26, and a drive transmission mechanism 27. The paper feed roller 25 may be supported rotatably at an end of the paper feed arm 26, which may be configured to move up and down selectively, such that the paper feed roller 25 selectively may approach and move away from the paper feed tray 20. The paper feed roller 25 may be driven to rotate by a driving force transferred through the drive transmission mechanism 27 from a paper feed motor 76. The drive transmission mechanism 27 may comprise a plurality of gears engaging one another. The paper feed roller 25 may press on the recording sheet 19 placed in the paper feed tray 20 and may rotate to feed the recording sheet 19 from the stack of recording sheets 19 to the feed path 23.

The paper feed unit 17 may feed the recording sheet 19 from the paper feed tray 20 through the feed path 23, e.g., a curved path 23A, to a feed roller pair 54. After being pinched by the feed roller pair 54, the recording sheet 19 may be fed through a straight path 23B by the feed roller pair 54. The feed roller pair 54 may be disposed along the feed path 23 downstream of the sheet detection unit 110. The paper feed unit 17 may feed the recording sheet 19 stored in the paper feed tray 20 to a pinch position, e.g., a certain position, of the feed roller pair 54 disposed downstream of the sheet detection unit 110. The feeding of the recording sheet 19 by the paper feed unit 17 from the paper feed tray 20 to the pinch position may be referred to as the "paper feeding operation."

Feed Path

As depicted in FIG. 2, in the printing unit 2, the feed path 23 may guide the recording sheet 19 and may extend from an end on the back side of the paper feed tray 20 through the recording unit 24 to the paper discharge tray 21. The feed path 23 may comprise the curved path 23A, which may be formed between the end of the paper feed tray 20 and the feed roller pair 54, and the straight path 23B, which may be formed between the feed roller pair 54 and the paper discharge tray 21.

The curved path 23A may be a path having a curved shape that extends from around the end of the paper feed tray 20 to the feed roller pair 54. The recording sheet 19 may be guided through the curved path 23A in a curved manner in a feed direction, e.g., the direction of arrows on a dash-dot line depicted in FIG. 2. The curved path 23A may be continuous with the straight path 23B between the feed roller pair 54.

The curved path 23A may be formed by the inner guide member 28 and the outer guide member 29 that face each other with a certain gap provided in-between. The inner guide member 28 and the outer guide member 29 may be members having substantially reduced thickness, plate shapes with curved surfaces on the curved path 23A side. The inner guide member 28 may form an inner side portion of the curved path 23A, and the outer guide member 29 may form an outer side portion of the curved path 23A.

The straight path 23B may be a path having a straight shape that extends from a downstream end of the curved path 23A in the feed direction, e.g., from the feed roller pair 54, to the paper discharge tray 21 in a front-back direction 12. The recording sheet 19 may be guided through the straight path 23B in the feed direction, e.g., the direction of arrows on a broken line depicted in FIG. 2. The recording sheet 19 may be discharged to the paper discharge tray 21 after an image is recorded thereon by the recording unit 24. The straight path 23B may be formed between a carriage 67 and a platen 66, in a portion in which the recording unit 24 may be arranged. In addition, the straight path 23B may be formed between the outer guide member 29 and the inner guide member 28 that face each other in portions other than the portion in which the recording unit 24 may be arranged.

Back Cover

As depicted in FIG. 2, the back cover 40 may be mounted on the back of the printing unit 2, e.g., on a back surface of the printing unit 2. The back cover 40 may be a member having a reduced thickness, plate shape, whose surface on the back side is substantially rectangular. The outer guide member 29 may be mounted on the front side of the back cover 40. Therefore, the outer guide member 29 may be supported by the back cover 40.

A shaft 41 may extend in the right-left direction 13, e.g., a direction perpendicular to the cross-sectional view which is depicted in FIG. 2, and may be provided at a lower end of the back cover 40. The back cover 40 may be configured such that the back cover pivot about the shaft 41 in the direction of an arrow 42. The state of the back cover 40 may pivot between a closed state, e.g., an state indicated by solid lines depicted in FIG. 2, and an exposed state, e.g., an state indicated by broken lines depicted in FIG. 2. Because the outer guide member 29 may be mounted on the back cover 40, the state of the back cover 40 may be changed together with that of the outer guide member 29. The back cover 40 may be mounted removably. A state in which the back cover 40 is mounted on the printing unit 2 may correspond to the second state, and a state in which the back cover 40 is removed from the printing unit 2 may correspond to the first state.

When the back cover 40 is in the closed state, the inner guide member 28 may be isolated from the exterior of the multifunction device 1, because the back side of the inner guide member 28 may be covered by the outer guide member 29. In addition, when the back cover 40 is in the closed state, the inner guide member 28 and the outer guide member 29 may form the curved path 23A and may guide the recording sheet 19. Thus, the recording sheet 19 may be guided through the curved path 23A. On the other hand, when the back cover 40 is in the exposed state, the inner guide member 28 may be exposed to the back side of the printing unit 2. Because the outer guide member 29 may incline backward when the back cover 40 is in the exposed state, the outer guide member 29 may not surround the curved path 23A and may not guide the recording sheet 19.

Feed Roller Pair and Discharge Roller Pair

As depicted in FIG. 2, the feed roller pair 54 may comprise a feed roller 47 arranged over the feed path 23 and a pinch roller 48 arranged under the feed path 23 and may be disposed downstream of the inner guide member 28 and the outer guide member 29 and upstream of the recording unit 24 in the feed direction. Downstream of the recording unit 24 in the feed direction, a discharge roller pair 55 having a discharge roller 49 arranged under the feed path 23 and a spur 50 arranged over the feed path 23 may be provided. The paper discharge tray 21 may be arranged downstream of the discharge roller pair 55 in the feed direction.

Figure 3:
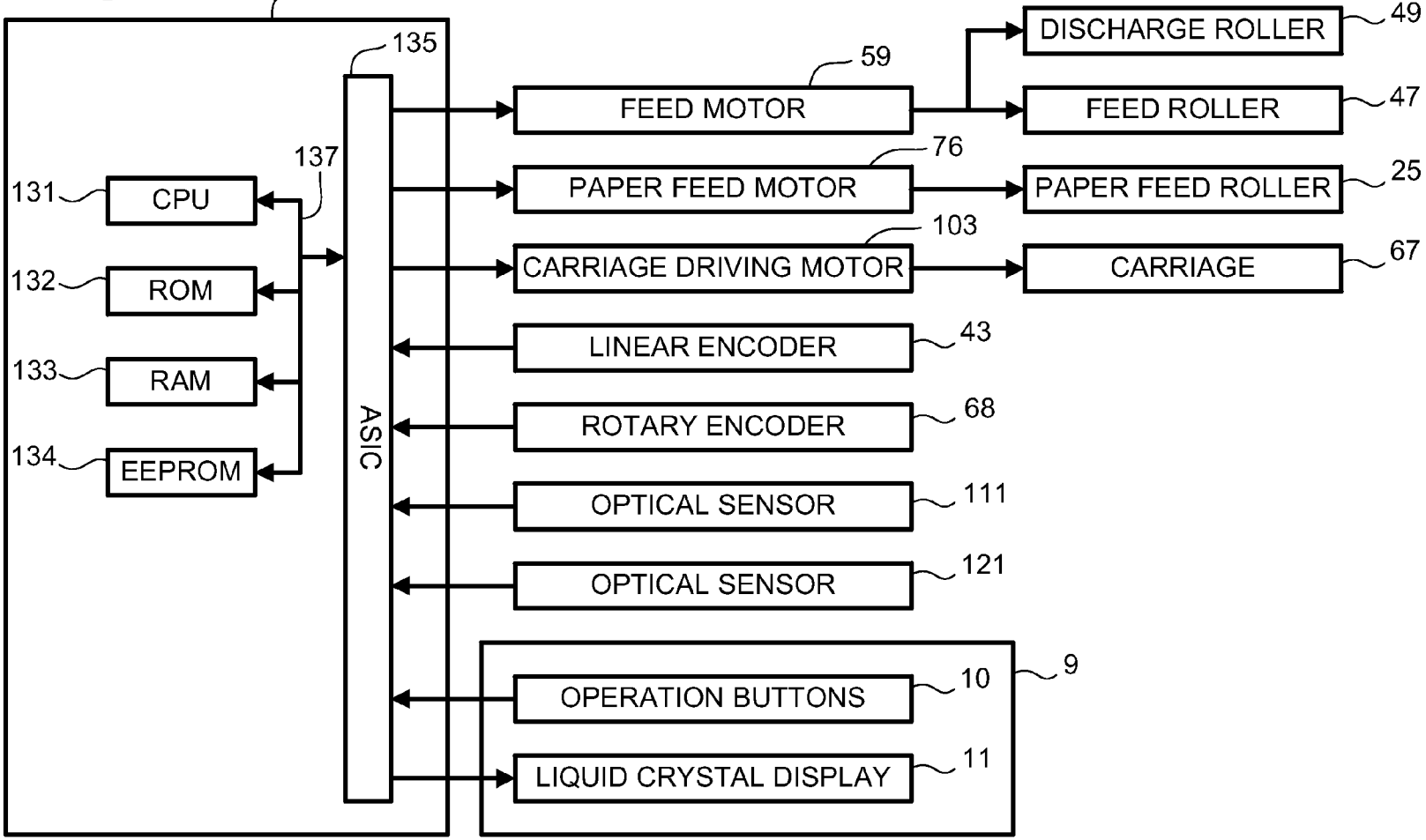
FIG. 3 is a diagram depicting the configuration of a microcomputer according to an embodiment of the invention.

The feed roller 47 and the discharge roller 49 may be rotated by driving force transmitted from a feed motor 59, as shown in FIG. 3, through a drive transmitting mechanism. The recording sheet 19 fed from the paper feed tray 20 by rotating the feed roller 47 in the forward direction, e.g., the counterclockwise direction in FIG. 2, may be pinched by the feed roller pair 54 and fed in the feed direction. By rotating the discharge roller 49 in the forward direction, e.g., the clockwise direction in FIG. 2, the recording sheet 19, on which the recording unit 24 has recorded an image, may be pinched by the discharge roller pair 55 and fed in the feed direction.

Rotary Encoder

As depicted in FIG. 2, a rotary encoder 68 may detect an amount of rotation of the paper feed roller 25. The rotary encoder 68 may comprise an encoder disc and an optical sensor. The encoder disc may be coaxial with the paper feed roller 25 and may rotate with the paper feed roller 25. The encoder disc may have a pattern in which transparent areas that transmit light and non-transparent areas that do not transmit light may be arranged alternately in predetermined intervals in the circumferential direction. When the encoder disc rotates together with the paper feed roller 25, a pulse signal may be generated when the optical sensor detects a movement of the pattern the rotary encoder 68. The pulse signal may be output to the microcomputer 130.

Recording Unit

As depicted in FIG. 2, the recording unit 24 may record an image on the recording sheet 19 using an inkjet method and may be disposed along the straight path 23B. The recording unit 24 may be disposed above the straight path 23B. The recording unit 24 may comprise the carriage 67 that may move back and forth in the right-left direction 13, e.g., a direction perpendicular to the face of the sheet, on which FIG. 2 is drawn, and a linear encoder 43, as shown in FIG. 3, for detecting the movement of the carriage 67. A recording head 65 may be mounted on the carriage 67. A plurality of nozzles may be provided on a bottom surface of the recording head 65. Each nozzle may be provided for each color of ink. Each nozzle may discharge each color of ink as a minute ink drop.

The recording head 65 may move in the right-left direction 13 relative to the recording sheet 19 fed onto the platen 66 provided below the recording unit 24 and may discharge ink drops onto the recording sheet 19. Thus, an image may be recorded on the recording sheet 19. The platen 66 may support the recording sheet 19 fed through the feed path 23. In another embodiment, the recording unit 24 may record an image on the recording sheet 19 using, for example, an electrophotography method.

First Detection Unit

As depicted in FIG. 2, the printing unit 2 may comprise the sheet detection unit 110, e.g., a first detection unit, that may detect the presence of the recording sheet 19 fed through the feed path 23. The sheet detection unit 110 may be disposed upstream of the feed roller pair 54 in the feed direction. The sheet detection unit 110 may be disposed along the feed path 23 downstream of upstream ends 29A and 28A of the outer guide member 29 and the inner guide member 28, respectively. The sheet detection unit 110 may be mounted on the inner guide member 28. In another embodiment, the sheet detection unit 110 may be mounted on the outer guide member 29 or on a member other than the inner guide member 28 and the outer guide member 29, such as a frame of the multifunction device 1 and disposed in the feed path 23 downstream of the upstream ends 29A and 28A of the outer guide member 29 and the inner guide member 28, respectively.

The sheet detecting unit 110 may comprise a rotary member 112 and an optical sensor 111, e.g., a photo interrupter. The rotary member 112 may comprise detection elements 112A and 112B. The optical sensor 111 may comprise a light emitting element, e.g., a light emitting diode, and a light receiving element, e.g., a phototransistor, which receives light emitted from the light emitting element. The rotary member 112 may be rotatable about a shaft 113. The detection element 112A may protrude from the shaft 113 into the feed path 23. When no external force is applied to the rotary member 112, the detection element 112B may interrupt an optical path extending from the light emitting element to the light receiving element of the optical sensor 111 and may shield the light passing through the optical path. The rotary member 112 may be rotated when pressed by a front end of the recording sheet 19. The detection element 112B then may be removed from the optical path to allow the light to pass through the optical path.

Although the rotator member 112 of the sheet detection unit 110 is configured in such a way as to come in contact with the recording sheet 19 in this embodiment, the sheet detection unit 110 may have a configuration in which the sheet detection unit 110 may detect the recording sheet 19 without making contact with the recording sheet 19. In this case, for example, either a light emitting device or a light receiving device may be mounted on the outer guide member 29, and the other may be mounted on the inner guide member 28. The sheet detection unit 110 then may be configured, such that the presence of the recording sheet 19 in the feed path 23 may be detected in accordance with whether or not the recording sheet 19 blocks an optical path from the light emitting device to the light receiving device in the feed path 23.

Third Detection Unit

As depicted in FIG. 2, the printing unit 2 may comprise a discharge detection unit 120, e.g., a third detection unit, which may detect the recording sheet 19 output from the feed path 23. The discharge detection unit 120 may be disposed between the recording unit 24 and the output roller pair 55 along the feed path 23. The discharge detection unit 120 may be disposed between the output roller pair 55 and the paper discharge tray 21. The discharge detection unit 120 may comprise a rotary member 122 and an optical sensor 121, e.g., a photo interrupter. The rotary member 122 may comprise detection elements 122A and 122B and a shaft 123. The optical sensor 121 may comprise a light emitting element, e.g., a light emitting diode, and a light receiving element, e.g., a phototransistor, which receives light emitted from the light emitting element. The configuration of the discharge detection unit 120 may be substantially the same as that of the sheet detecting unit 110.

Processor

Referring to FIG. 3, the microcomputer 130 may control the operation of the multifunction device 1. The microcomputer 130 may comprise a CPU 131, ROM 132, RAM 133, EEPROM 134, an ASIC 135 and an internal bus 137 which may connect these components with each other.

The ROM 132 may store programs, with which the CPU 131 may control various operations of the multifunction device 1 including record control. RAM 133 may be used as a storage area which may record temporarily data used when CPU 131 performs the above-described programs, generates that above-described signals, and the like.

The EEPROM 134 may store settings, flags, and the like to be held even after power off. Particular information may be stored in the EEPROM 134. The particular information may comprise, for example, a flag set in a certain address of the EEPROM 134. The particular information may comprise a flag that may be turned on when a paper jam occurs and may be turned off when the recording sheet 19 fed through the feed path 23 is detected by the sheet detection unit 110, after the paper jam is cleared.

In another embodiment, the particular information may be stored in a random-access memory (RAM) 133. For example, while the power supply of the multifunction device 1 is off, the particular information may be stored in the EEPROM 134, and, when the power supply of the multifunction device 1 is turned on, the particular information may be moved or copied from the EEPROM 134 to the RAM 133. In another example, while the power supply of the multifunction device 1 is on, the particular information may be stored in the RAM 133, and, when the power supply of the multifunction device 1 is turned off, the particular information may be moved or copied from the RAM 133 to the EEPROM 134.

The feed motor 59, the paper feed motor 76, a carriage driving motor 103, the linear encoder 43, the rotary encoder 68, the optical sensor 111 of the sheet detection unit 110, the optical sensor 121 of the discharge detection unit 120, the operation panel 9, and the like may be connected to an application-specific integrated circuit (ASIC) 135. Driving circuits for controlling each of the motors may be incorporated in the ASIC 135. When the CPU 131 inputs a drive signal for driving each motor to rotate in a driving circuit corresponding to a predetermined motor, a driving current in accordance with the drive signal may be output to the corresponding motor from the driving circuit. The corresponding motor then may rotated in the forward or reverse direction at a predetermined speed according to the drive signal.

The optical sensor 111 of the sheet detection unit 110 and the optical sensor 121 of the discharge detection unit 120 may output analog electrical signals, e.g., voltage signals or current signals, according to the intensity of light received by respective light receiving devices thereof. The output signals may be input to the microcomputer 130. The microcomputer 130 may judge whether the electrical levels, e.g., values of voltage or current, of the input signals are equal to or greater than a certain threshold. If the electrical levels of the input signals are equal to or greater than the certain threshold, the input signals may be judged to be "high" level signals. If not, the input signals may be judged to be "low" level signals. Thus, the microcomputer 130 may judge whether the recording sheet 19 is detected by the sheet detection unit 110 and the discharge detection unit 120. The microcomputer 130 may judge whether the recording sheet 19 is in a first portion in which the sheet detection unit 110 is provided, or in a second portion in which the discharge detection unit 120 is provided. The sheet detection unit 110 and the microcomputer 130 may be an example of a first detection unit.

The ASIC 135 may receive a pulse signal output from the rotary encoder 68. The microcomputer 130 may calculate the amount of rotation of the paper feed roller 25 based on the pulse signal from the rotary encoder 68. The microcomputer 130 may detect the amount of rotation of the paper feed roller 25 based on the pulse signal from the rotary encoder 68. The rotary encoder 68 and the microcomputer 130 may be an example of a second detection unit.

The ASIC 135 may receive a pulse signal output from the linear encoder 43. The microcomputer 130 may detect the position of the carriage 67 in the right-left direction 13 based on the pulse signal from the linear encoder 43.

When a certain condition is established in execution of recording control, the microcomputer 130 may display a certain message on the liquid crystal display unit 11 of the operation panel 9. Therefore, the multifunction device 1 may generate a notification of a certain piece of information. In another embodiment, an audio message may be output from a speaker or the content of a message may be indicated by how a light-emitting diode (LED) flashes.

Recording Control

Figure 4:
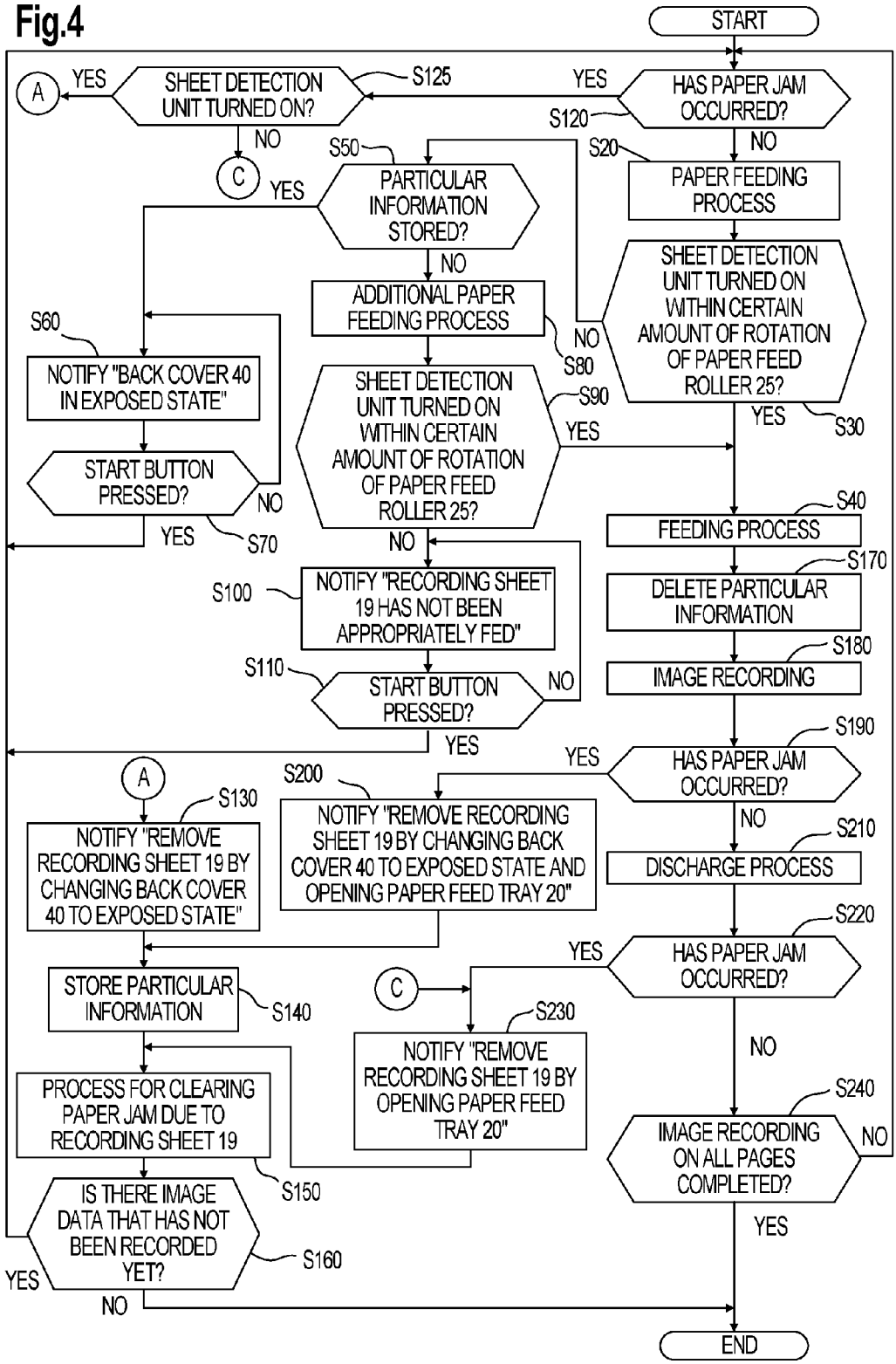
FIG. 4 is a flowchart depicting a recording control process according to an embodiment of the invention.

The microcomputer 130 may perform a series of record control in which the recording sheet 19 may be fed and image data may be recorded thereon. Referring to FIGS. 4 and 5, when a command to record image data, e.g., image recording, on the recording sheet 19 stored in the paper feed tray 20 is input from an external information device to the microcomputer 130, or to the microcomputer 130 by an operation performed on the operation panel 9, the microcomputer 130 may judge whether a paper jam has occurred in step S120. If a paper jam has occurred, e.g., YES in step S120, processing in step S125 and the subsequent steps may be executed.

On the other hand, if a paper jam has not occurred, e.g., NO in step S120, the microcomputer 130 may drive the paper feed motor 76 to rotate the paper feed roller 25. The recording sheet 19 stored in the paper feed tray 20 may be fed to the feed roller pair 54 through the feed path 23 in step S20.

The microcomputer 130 may calculate the amount of rotation of the paper feed roller 25 since the beginning of the driving of the paper feed motor 76 based on the a pulse signal from the rotary encoder 68. The microcomputer 130 may refer to a value of an input signal from the optical sensor 111 of the sheet detection unit 110. The microcomputer 130 then may judge whether the electrical signal input from the optical sensor 111 changes from a low level, e.g., OFF, to a high level, e.g., ON, before the amount of rotation of the paper feed roller 25 reaches a certain amount of rotation. The microcomputer 130 may judge whether the recording sheet 19 is detected by the sheet detection unit 110 before the amount of rotation of the paper feed roller 25 reaches the certain amount of rotation in step S30. The certain amount of rotation may be a predetermined amount of rotation as the amount of rotation of the paper feed roller 25 required to feed the recording sheet 19 from the paper feed tray 20 to the sheet detection unit 110 (or to a position along the feed path 23 downstream of the sheet detection unit 110 by a certain distance).

If the recording sheet 19 is detected by the sheet detection unit 110 before the amount of rotation of the paper feed roller 25 reaches the certain amount of rotation, e.g., YES in step S30, the microcomputer 130 may drive the feed motor 59 to rotate the feed roller 47. Therefore, the recording sheet 19 fed by the paper feed roller 25 through the feed path 23 may be pinched by the feed roller pair 54. The recording sheet 19 then may be fed to a position immediately below the recording head 65 by the feed roller pair 54 at step S40. The microcomputer 130 may drive the feed motor 59 before the recording sheet 19 is detected by the sheet detection unit 110, e.g., when the driving of the paper feed motor 76 begins.

On the other hand, if the recording sheet 19 is not detected by the sheet detection unit 110 before the amount of rotation of the paper feed roller 25 reaches the certain amount of rotation, e.g., NO in step S30, the microcomputer 130 may judge whether the particular information is stored in the EEPROM 134 in step S50. The particular information may be stored in the microcomputer 130 in step S140 and may be deleted from the EEPROM 134 in step S170. In step S50, the microcomputer 130 may judge whether the particular information is stored in the EEPROM 134 in recording control for another recording sheet 19 executed before the current recording control.

If the particular information is stored in the EEPROM 134, e.g., YES in step S50, the microcomputer 130 may generate a notification that the back cover 40 of the multifunction device 1 is in the exposed state. In step S60, the microcomputer 130 may control the operation panel 9 to cause the liquid crystal display unit 11 to display a message depicted in FIG. 5A. If the recording sheet 19 is not detected by the sheet detection unit 110 before the amount of driving of the paper feed unit 17 since the beginning of a paper feeding operation detected by the rotary encoder 68 reaches the certain amount of driving, e.g., NO in step S30 and if the particular information is stored in the EEPROM 134, e.g., YES in step S50, the microcomputer 130 may generate a notification that the back cover 40 of the multifunction device 1 is in the exposed state in step S60. The processing in steps S30, S50, and S60 may be an example of a notification unit. The message remains displayed until the start button is pressed in accordance with the message, e.g., NO in step S70. If the start button is pressed, e.g., YES in step S70, a new recording sheet 19 may be fed from the paper feed tray 20 by the paper feed roller 25 in step S20 after the judgment as to whether a paper jam has occurred in step S120.

On the other hand, if the particular information is not stored in the microcomputer 130, e.g., NO in step S50, the microcomputer 130 may execute an additional paper feeding process, which is substantially the same process as that in step S20. Therefore, a new recording sheet 19 may be fed from the paper feed tray 20 by the paper feed roller 25 in step S80. The additional paper feeding process may be executed, because a recording sheet 19 may be fed again if the recording sheet 19 cannot be fed properly due to a slip of the paper feed roller 25 or the like. If the additional paper feeding process is to be executed, the back cover 40 may likely be open.

If the recording sheet 19 is not detected by the sheet detection unit 110 before the amount of driving of the paper feed unit 17 since the beginning of a paper feeding operation detected by the rotary encoder 68 reaches the certain amount of driving, e.g., NO in step S30, and if the particular information is not stored in the EEPROM 134, e.g., NO in step S50, the microcomputer 130 may control the paper feed unit 17 to execute the paper feeding operation again in step S80.

In the recording control, the additional paper feeding process may not be executed. That is, step S90 may be executed after step S50 without executing step S80.

If the particular information is not stored in the EEPROM 134 in step S50, the microcomputer 130 may not control the paper feed unit 17 to execute the paper feeding operation again, and the process in step S60 may be executed. That is, the processing in steps S30, S50, and S80 may be an example of a feed control unit.

At step S90, the microcomputer 130 then may judge whether the recording sheet 19, which newly has been fed, is detected by the sheet detection unit 110 before a certain amount of rotation of the paper feed roller 25, e.g., the microcomputer 130 may make substantially the same judgment as in step S30. The certain amount of rotation in step S90 may be the same as that in step S30. In another embodiment, the certain amount of rotation in step S90 may be different from that in step S30. For example, the certain amount of rotation in the additional paper feeding process in step S80) may be less than that in the paper feeding process in step S20.

If the recording sheet 19 is detected by the sheet detection unit 110 before the amount of rotation of the paper feed roller 25 reaches the certain amount of rotation, e.g., YES in step S90, the microcomputer 130 may execute the processing in step S40. Therefore, the recording sheet 19 may be fed to the position immediately below the recording head 65 by the feed roller pair 54 in step S40.

On the other hand, if the recording sheet 19 is not detected by the sheet detection unit 110 before the amount of rotation of the paper feed roller 25 reaches the certain amount of rotation, e.g., NO in step S90, the microcomputer 130 may generate a notification that the recording sheet 19 of the multifunction device 1 has not been fed properly. More specifically, in step S100, the microcomputer 130 may control the operation panel 9 to cause the liquid crystal display unit 11 to display a message depicted in FIG. 5B. The notification may be executed after the paper feeding operation is executed again in step S80. A message "check whether there are sheets in paper feed tray" is depicted in FIG. 5B. A message "check whether paper feed tray is mounted" may be displayed in addition to the above message when the paper feed tray 20 is removably mounted.

Situations, in which the recording sheet 19 has not been fed properly, may comprise a first situation, in which the recording sheet 19 has not been fed through the curved path 23A, because the recording sheet 19 is not stored in the paper feed tray 20, and a second situation, in which the recording sheet 19 has not been fed through the curved path 23A, because the paper feed tray 20 is removed from the multifunction device 1.

If the recording sheet 19 is not detected by the sheet detection unit 110 before the amount of driving of the paper feed unit 17 since the beginning of a paper feeding operation detected by the rotary encoder 68 reaches the certain amount of driving, e.g., NO in step S30) and, if the particular information is not stored in the EEPROM 134, e.g., NO in step S50, the microcomputer 130 may generate a notification that the recording sheet 19 of the multifunction device 1 has not been fed properly in step S100. As with the processing in steps S30, S50, and S60, the processing in step S100 may be another example of the notification unit. The message may be displayed continuously until the start button is pressed in accordance with the message, e.g., NO in step S110. If the start button is pressed, e.g., YES in step S110, a new recording sheet 19 may be fed from the paper feed tray 20 by the paper feed roller 25 in step S20 after the judgment as to whether a paper jam has occurred in step S120.

In step S30, if the recording sheet 19 is detected by the sheet detection unit 110 before the amount of rotation of the paper feed roller 25 reaches the certain amount of rotation, e.g., YES in step S30, the microcomputer 130 may begin to control the feed roller pair 54 to feed the recording sheet 19 in step S40 and may delete the particular information from the EEPROM 134 in step S170. The process in step S170 may be an example of a particular information control unit. The microcomputer 130 then may control the recording unit 24 to execute the image recording on the recording sheet 19 in step S180.

If a paper jam occurs before the recording sheet 19 is detected by the discharge detection unit 120 after the image recording on the recording sheet 19 is begun, e.g., YES in step S190, step S200 and the subsequent steps may be executed.

In step S190, if a paper jam does not occur before the recording sheet 19 is detected by the discharge detection unit 120, e.g., NO in step S190, the recording sheet 19 may be discharged to the paper discharge tray 21 by the discharge roller pair 55 in step S210.

If a paper jam occurs after the recording sheet 19 is detected by the discharge detection unit 120, e.g., YES in step S220, step S230 and the subsequent steps may be executed.

If a paper jam does not occur after the recording sheet 19 is detected by the discharge detection unit 120, e.g., NO in step S220, the microcomputer 130 may judge whether the image recording for all pages has been completed in step S240. If the image recording for all pages has not been completed, e.g., NO in step S240, a new recording sheet 19 on which image data on a next page is to be recorded is fed from the paper feed tray 20 by the paper feed roller 25 in step S20. If the image recording for all pages has been completed, e.g., YES in step S240, the series of operations of the recording control may terminate.

If a paper jam has occurred in step S120, e.g., YES in step S120, step S125 may be executed. The occurrence of a paper jam may be judged, for example, in the following manner in steps S120 and S125. In step S120, the microcomputer 130 may judge whether the recording sheet 19 is detected by the sheet detection unit 110 or by the discharge detection unit 120. If the recording sheet 19 is detected by the sheet detection unit 110 or by the discharge detection unit 120, the microcomputer 130 may judges whether the recording sheet 19 is detected by the sheet detection unit 110 in step S125.

If the recording sheet 19 is detected by the sheet detection unit 110, e.g., YES in step S125, the recording sheet 19 may be present at least in the curved path 23A, although the paper feed unit 17 has not begun to feed the recording sheet 19. The microcomputer 130 may judge that a paper jam has occurred in the curved path 23A, e.g., in a portion around the back surface of the multifunction device 1, due to the recording sheet 19. Step S130 and the subsequent steps hen may be executed. On the other hand, if the recording sheet 19 is not detected by the sheet detection unit 110, e.g., NO in step S125, the recording sheet 19 may be present in the straight path 23B, although the paper feed unit 17 has not begun to feed the recording sheet 19. The microcomputer 130 may judge that a paper jam has occurred in a portion around the front surface of the multifunction device 1 due to the recording sheet 19. Step S230 and the subsequent steps then may be executed.

In step S130, the microcomputer 130 may notify the user of the multifunction device 1 that the back cover 40 may be open to the exposed state to remove the recording sheet 19 from the feed path 23. More specifically, the microcomputer 130 may control the operation panel 9 to cause the liquid crystal display unit 11 to display a message depicted in FIG. 5C.

The microcomputer 130 then may store the particular information in the EEPROM 134 in step S140. Thereafter, a process for clearing the paper jam due to the recording sheet 19 may be executed in step S150.

On the other hand, in step S230, the microcomputer 130 may generate a notification that the paper feed tray 20 of the multifunction device 1 may be pulled out from the printing unit 2 to remove the recording sheet 19 from the feed path 23. The microcomputer 130 may control the operation panel 9 to cause the liquid crystal display unit 11 to display a message as depicted in FIG. 5F. Thereafter, the step S150 and the subsequent steps may be executed.

In step S150, the microcomputer 130 may judge whether the recording sheet 19 is detected by the sheet detection unit 110 and the discharge detection unit 120. If at least one of the sheet detection unit 110 and the discharge detection unit 120 detects the recording sheet 19, the microcomputer 130 may judge that the paper jam due to the recording sheet 19 has not been cleared yet. On the other hand, if neither the sheet detection unit 110 nor the discharge detection unit 120 detects the recording sheet 19 after the recording sheet 19 is removed from the feed path 23, the microcomputer 130 may judge that the paper jam due to the recording sheet 19 has been cleared. For example, if the back cover 40 is opened and the recording sheet 19 is removed in accordance with the message displayed in step S130, the recording sheet 19 may no longer be detected by the sheet detection unit 110.

Further, the following process may be executed in step S150 before step S160 is executed. If the recording sheet 19 is no longer detected by the sheet detection unit 110 and the discharge detection unit 120, the microcomputer 130 may control the operation panel 9 to delete the message, e.g., the message depicted in FIG. 5C or 5F, displayed on the liquid crystal display unit 11 and may cause the liquid crystal display unit 11 to display a message depicted in FIG. 5D. The body cover 35 may be opened and it may be confirmed that there is no foreign object in the multifunction device 1, and the body cover 35 then may be closed again. A detection unit for detecting opening and closing of the body cover 35 may be provided on either the body cover 35 or the printing unit 2, and the microcomputer 130 may detect the opening or closing of the body cover 35 based on a detection signal from the detection unit. The message depicted in FIG. 5D may be deleted from the liquid crystal display unit 11 when the body cover 35 is closed and when the paper jam has been detected to be cleared. When the body cover 35 is closed, the multifunction device 1 may resume normal operation, and the microcomputer 130 may execute step S160.

Whether the multifunction device 1 has resumed normal operation may be judged in accordance with whether the sheet detection unit 110 and the discharge detection unit 120 detect the recording sheet 19. Therefore, the above-described process for opening and closing the body cover 35 may not be executed. When the process for opening and closing the body cover 35 is not executed, the multifunction device 1 may resume normal operation when the start button is pressed, and the microcomputer 130 may execute step S160.

In step S160, the microcomputer 130 may judge whether there is image data in the RAM 133 that has not been recorded on the recording sheet 19 yet. For example, when a plurality of pieces of image data have been transmitted from an external information device, there may be a piece of image data in the RAM 133 that has not been recorded on the recording sheet 19 yet. If there is image data in the RAM 133 that has not been recorded, e.g., YES in step S160, a new recording sheet 19, on which the image data is to be recorded, may be fed from the paper feed tray 20 by the paper feed roller 25 in step S20 after the judgment as to whether a paper jam has occurred in step S120. On the other hand, if there is no image data in the RAM 133 that has not been recorded, e.g., NO in step S160, the series of operations of the recording control may end.

If a paper jam has occurred in step S190, e.g., YES in step S190, step S200 may be executed. Whether a paper jam has occurred may be judged in the following manner in step S190. If the carriage 67 stops moving before reaching a target position while the recording unit 24 is executing the image recording on the recording sheet 19, the microcomputer 130 may judge that the carriage 67 may have crashed into the recording sheet 19. The microcomputer 130 then may judge that a paper jam has occurred due to the recording sheet 19 in the straight path 23B at the center of the printing unit 2 in the front-back direction 12. A stoppage of the carriage 67 may be judged based on a pulse signal from the linear encoder 43.

In step S200, the microcomputer 130 may notify the user of the multifunction device 1 that the recording sheet 19 may be removed from the feed path 23 by opening the body cover 35. More specifically, the microcomputer 130 may control the operation panel 9 to cause the liquid crystal display unit 11 to display a message, as depicted in FIG. 5E.

The microcomputer 130 then may store the particular information in the EEPROM 134 at step S140, and may execute step S150 and the subsequent steps.

If a paper jam has occurred in step S220, e.g., YES in step S220, step S230 may be executed. Whether a paper jam has occurred may be judged, for example, in the following manner in step S220. If the recording sheet 19 remains detected even after the amount of rotation of the discharge roller 49 since the detection of the recording sheet 19 by the discharge detection unit 120 becomes greater than a set amount of rotation, the microcomputer 130 may judge that a paper jam has occurred due to the recording sheet 19 in the feed path 23 at the front side of the printing unit 2, e.g., in a portion close to the front surface. The set amount of rotation may be an amount of rotation predetermined as the amount of rotation of the discharge roller 49 required to feed the recording sheet 19 until a trailing end of the recording sheet 19 passes the discharge detection unit 120 after a leading end of the recording sheet 19 passes the discharge detection unit 120. The amount of rotation of the discharge roller 49 may be calculated by a rotary encoder, which may be provided in the discharge roller 49 and which may have substantially the same configuration as the rotary encoder 68. A pulse signal from the rotary encoder may be input to the microcomputer 130 for calculation.

In step S230, the microcomputer 130 may generate a notification that the recording sheet 19 the multifunction device 1 may be removed from the feed path 23 by pulling out the paper feed tray 20 from the printing unit 2. The microcomputer 130 may control the operation panel 9 to cause the liquid crystal display unit 11 to display the message depicted in FIG. 5F. Step S150, and the subsequent steps may than be executed.

The portion of the multifunction device 1, in which a paper jam has occurred due to the recording sheet 19, e.g., one of a portion close to the back surface, a portion close to the center, and a portion close to the front surface, may be judged based on the judgments made in steps S120, S190, and S220. Steps S120, S190, and S220 may be an example of a judgment unit.

As described above, if it is judged in step S125 or S190 that a paper jam has occurred due to the recording sheet 19 in a portion close to the back surface of the multifunction device 1, e.g., YES in step S120 or S190, the microcomputer 130 may store the particular information in the EEPROM 134 in step S140. Step S140 may be an example of the particular information control unit. On the other hand, even if it is judged in step S220 that a paper jam has occurred, e.g., YES in step S220, the microcomputer 130 may not store the particular information in the EEPROM 134. The microcomputer 130 may determine whether to store the particular information in the EEPROM 134 based on the results of the judgments made in steps S120, S190, and S220.

Advantageous Effects

If the microcomputer 130 judges that a paper jam has occurred, the state of the back cover 40 may change from the closed state to the exposed state to remove the recording sheet 19 from the feed path 23. After removing the recording sheet 19 from the feed path 23, the user may forget to change the state of the back cover 40 from the exposed state to the closed state.

If it is judged that a paper jam has occurred, the microcomputer 130 may store the particular information in the EEPROM 134. When the particular information has been stored, the microcomputer 130 may cause the liquid crystal display unit 11 to display information indicating that the back cover 40 is in the exposed state, unless the recording sheet 19 is detected by the sheet detection unit 110 before the amount of driving of the paper feed unit 17 reaches the certain amount of driving. When the user forgets to close the back cover 40, the microcomputer 130 may generate a notification that the back cover 40 remains open.

On the other hand, if the particular information is not stored in the EEPROM 134, it may be unlikely that the state of the back cover 40 has been changed from the closed state to the exposed state. In such a case, the microcomputer 130 may cause the liquid crystal display unit 11 to display information indicating that the recording sheet 19 has not been fed properly, unless the recording sheet 19 is detected by the sheet detection unit 110 before the amount of driving of the paper feed unit 17 reaches the certain amount of driving. When it is unlikely that the back cover 40 has opened, the microcomputer 130 may generate a notification that, for example, the recording sheet 19 is not stored in the paper feed tray 20.

Therefore, the user may be notified of appropriate measures if a sheet is not detected by a sensor within a certain amount of feeding after the sheet is fed from a tray.

In addition, the recording sheet 19 may not be fed properly although the paper feed unit 17 has been driven. For example, if the rotating paper feed roller 25 slips on the recording sheet 19, the recording sheet 19 may not be fed properly. Therefore, the microcomputer 130 may execute the paper feeding operation again if the particular information is not stored and the sheet detection unit 110 does not detect the recording sheet 19. Thus, the paper feeding operation may be executed again if the recording sheet 19 is not picked up by the rotating paper feed roller 25.

If the recording sheet 19 is fed while the back cover 40 is in the exposed state, because the recording sheet 19 is not guided by the back cover 40, the recording sheet 19 may come out of the multifunction device 1. The paper feeding operation may be executed again if the EEPROM 134 does not store the particular information, e.g., if it is unlikely that the back cover 40 is in the exposed state. If the microcomputer 130 stores the particular information, e.g., if it is possible that the back cover 40 is in the exposed state, the paper feed unit 17 may not execute the paper feeding operation again. Therefore, the number of recording sheets 19 that come out of the multifunction device 1 may be reduced.

In addition, for example, the microcomputer 130 may store the particular information in the EEPROM 134 if the back cover 40 is provided on the back surface of the multifunction device 1 and the position of a paper jam is on the back side of the multifunction device 1. On the other hand, if the position of a paper jam is on the front side of the multifunction device 1, the microcomputer 130 may not store the particular information in the EEPROM 134. Thus, the microcomputer 130 may store the particular information when it is possible that the user may forget to close the back cover 40, and may not store the particular information in the EEPROM 134 when it is unlikely that the user has opened the back cover 40.

Second Embodiment

If it is judged that the particular information is not stored in the EEPROM 134, e.g., NO in step S50, the microcomputer 130 may execute the additional paper feeding process in step S80, and if it is judged that the particular information is stored in the EEPROM 134, e.g., YES in step S50, the microcomputer 130 may not execute the additional paper feeding process. In the second embodiment, if it is judged that the particular information is not stored in the EEPROM 134, e.g., NO in step S50, the microcomputer 130 may execute the additional paper feeding process for a first certain number of times, e.g., a predetermined first certain number of times, and if it is judged that the particular information is stored in the EEPROM 134, e.g., YES in step S50, the microcomputer 130 may execute the additional paper feeding process for a second certain number of times, e.g., a second certain number of times, less than the first certain number of times.

The first certain number of times may be stored in a read-only memory (ROM) 132 or the EEPROM 134, or may be stored in the RAM 133 or the EEPROM 134 through an operation of the user performed on the operation panel 9. The second certain number of times may be predetermined in the same method as for the first certain number of times. For example, the first certain number of times may be set to three, and the second certain number of times may be set to two.

Figure 6:
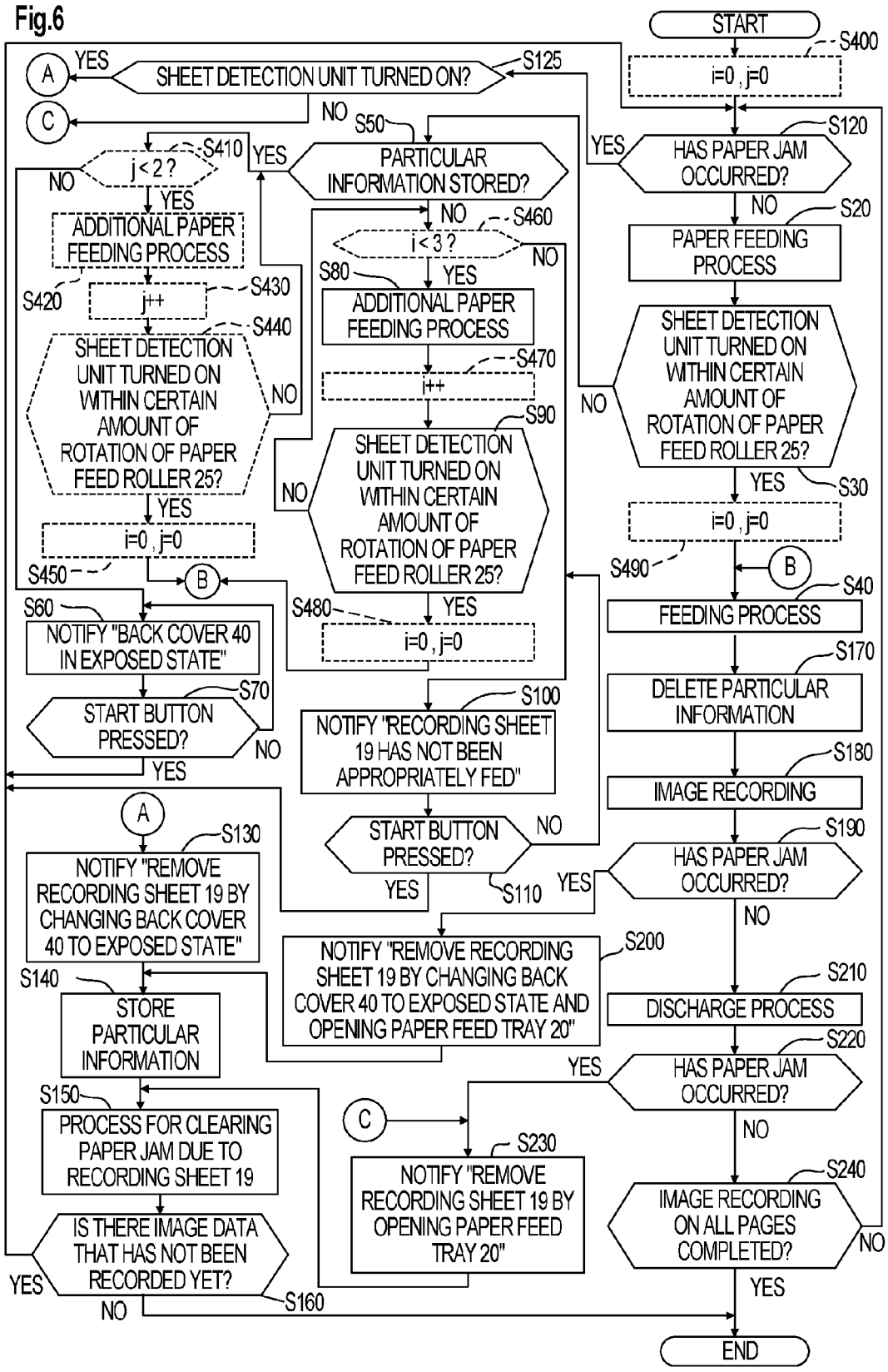
FIG. 6 is a flowchart depicting a recording control process according to a second embodiment of the invention.

Referring to FIG. 6, a process according to the second embodiment may comprise additional steps S400 to S490 indicated by broken lines to the flowchart of FIG. 4. The other steps in FIG. 6 may be substantially the same as the steps in FIG. 4.

When a command to execute the image recording is input from an external information device to the microcomputer 130 or to the microcomputer 130 by an operation performed on the operation panel 9, count values i and j may be set to zero in step S400.

If the particular information is stored in the EEPROM 134, e.g., YES in step S50, the microcomputer 130 may judges whether the count value j is less than two in step S410. If the count value j is greater than or equal to two, e.g., NO in step S410, step S60 may be executed. On the other hand, if the count value j is less than two, e.g., YES in step S410, the additional paper feeding process may be executed in step S420, and the count value j may be increased by one in step S430. The microcomputer 130 then may judge whether the recording sheet 19 that has been newly fed is detected by the sheet detection unit 110 before the amount of rotation of the paper feed roller 25 reaches a certain amount of rotation in step S440. If the recording sheet 19 is detected by the sheet detection unit 110 before the amount of rotation of the paper feed roller 25 reaches the certain amount of rotation, e.g., YES in step S440, the microcomputer 130 may reset the count values i and j to zero in step S450 and may execute the processing in step S40. On the other hand, if the recording sheet 19 is not detected by the sheet detection unit 110 before the amount of rotation of the paper feed roller 25 reaches the certain amount of rotation, e.g., NO in step S440, step S410 may be executed again.

If the particular information is stored in the EEPROM 134, e.g., YES in step S50, the additional paper feeding process may be executed until the count value j becomes greater than or equal to two, e.g., NO in step S410, or until the recording sheet 19 is no longer detected by the sheet detection unit 110 before the amount of rotation of the paper feed roller 25 reaches the certain amount of rotation, e.g., NO in step S440. The additional paper feeding process may be executed up to two times, e.g., the second certain number of times.

On the other hand, if the particular information is not stored in the EEPROM 134, e.g., NO in step S50, the microcomputer 130 may judge whether the count value i is less than three in step S460. If the count value i is greater than or equal to three, e.g., NO in step S460, step S100 may be executed. On the other hand, if the count value i is less than three, e.g., YES in step S460, the additional paper feeding process may be executed in step S80, and the count value i may be increased by one in step S470. The microcomputer 130 then may judge whether the recording sheet 19 that has been newly fed is detected by the sheet detection unit 110 before the amount of rotation of the paper feed roller 25 reaches the certain amount of rotation in step S90. If the recording sheet 19 is detected by the sheet detection unit 110 before the amount of rotation of the paper feed roller 25 reaches the certain amount of rotation, e.g., YES in step S90, the microcomputer 130 may reset the count values i and j to zero in step S480 and may execute step S40. On the other hand, if the recording sheet 19 is not detected by the sheet detection unit 110 before the amount of rotation of the paper feed roller 25 reaches the certain amount of rotation, e.g., NO in step S90, step S460 may be executed again.

If the particular information is not stored in the EEPROM 134, e.g., NO in step S50, the additional paper feeding process may be executed repeatedly until the count value i becomes greater than or equal to three, e.g., NO in step S460, or until the recording sheet 19 is no longer detected by the sheet detection unit 110 before the amount of rotation of the paper feed roller 25 reaches the certain amount of rotation, e.g., NO in step S90. The additional paper feeding process may be executed up to three times, e.g., the first certain number of times.

If the recording sheet 19 is fed while the back cover 40 is in the exposed state, because the recording sheet 19 may not be guided by the back cover 40, the recording sheet 19 may come out of the multifunction device 1. Therefore, the number of operations for feeding the recording sheet 19 executed by the paper feed unit 17 may be decreased when it is possible that the back cover 40 is in the exposed state. The number of recording sheets 19 coming out of the multifunction device 1 may be reduced.

Third Embodiment

Figure 5A:
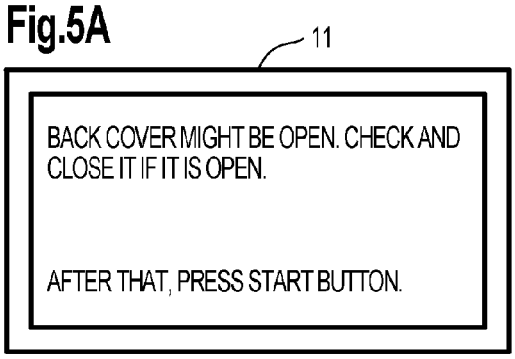
FIG. 5A is a diagram depicting a message displayed on a liquid display unit according to an embodiment of the invention.
Figure 5B:
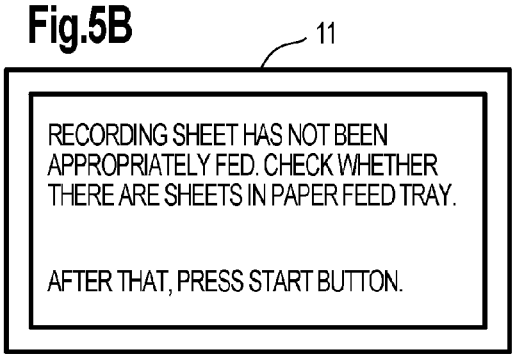
FIG. 5B is a diagram depicting another message displayed on a liquid display unit according to an embodiment of the invention.
Figure 5C:
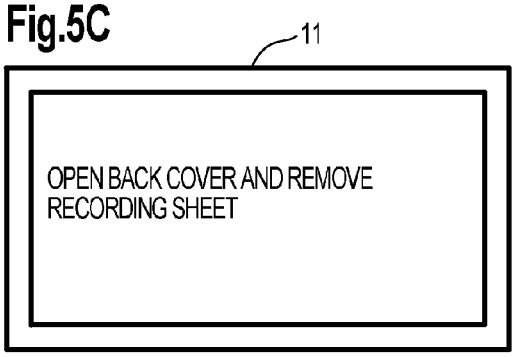
FIG. 5C is a diagram depicting still another message displayed on a liquid display unit according to an embodiment of the invention.
Figure 5D:
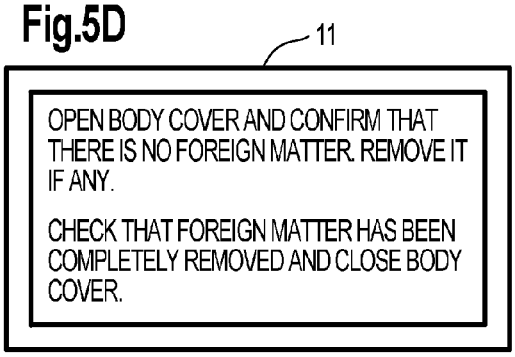
FIG. 5D is a diagram depicting yet another message displayed on a liquid display unit according to an embodiment of the invention.
Figure 5E:
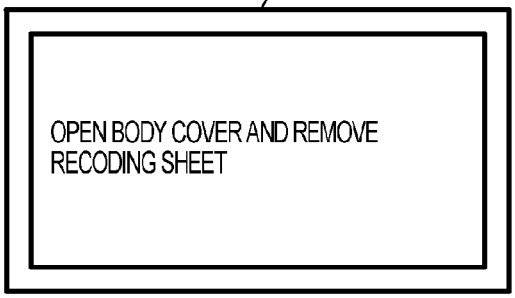
FIG. 5E is a diagram depicting a further message displayed on a liquid display unit according to an embodiment of the invention.
Figure 5F:
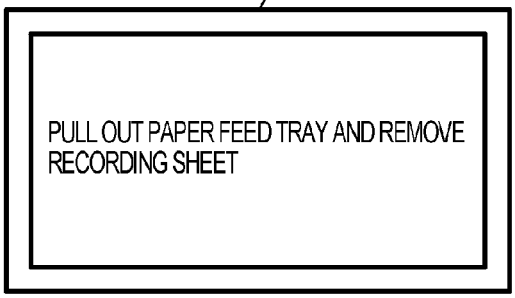
FIG. 5F is a diagram depicting still a further message displayed on a liquid display unit according to an embodiment of the invention.
Figure 5G:
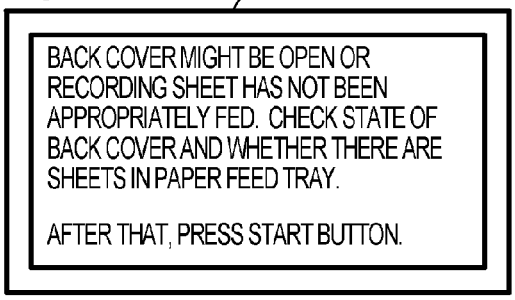
FIG. 5G is a diagram depicting yet a further message displayed on a liquid display unit according to an embodiment of the invention.

In step S60 depicted in FIG. 4, the microcomputer 130 may control the operation panel 9 to cause the liquid crystal display unit 11 to display the message depicted in FIG. 5A. In the third embodiment, the microcomputer 130 may notify the user of the multifunction device 1 not only that the back cover 40 is in the exposed state but also that the recording sheet 19 has not been appropriately fed. The microcomputer 130 may control the operation panel 9 to cause the liquid crystal display unit 11 to display a message depicted in FIG. 5G. If the recording sheet 19 is not detected by the sheet detection unit 110 before the amount of rotation of the paper feed roller 25 reaches the certain amount of rotation, e.g., NO in step S30, and the particular information is stored in the EEPROM 134, e.g., YES in step S50, the microcomputer 130 may notify the user of the multifunction device 1 of information indicating that the recording sheet 19 has not been fed properly and information indicating that the back cover 40 is in the exposed state. Although a message "check whether there are sheets in paper feed tray" may be displayed as depicted in FIG. 5G, a message "check whether paper feed tray is mounted" may be displayed in addition to the above message when the paper feed tray 20 is removably mounted.

Fourth Embodiment

If the start button is pressed for a third certain number of times, e.g., a third certain number of times, while the particular information remains stored in the EEPROM 134, the microcomputer 130 may delete the particular information stored in the EEPROM 134. In the fourth embodiment, the third certain number of times may be set to three. In another embodiment, the third certain number of times may be one or more.

The third certain number of times may be stored in the ROM 132 or the EEPROM 134, or may be stored in the RAM 133 or the EEPROM 134 through an operation performed on the operation panel 9.

Figure 7:
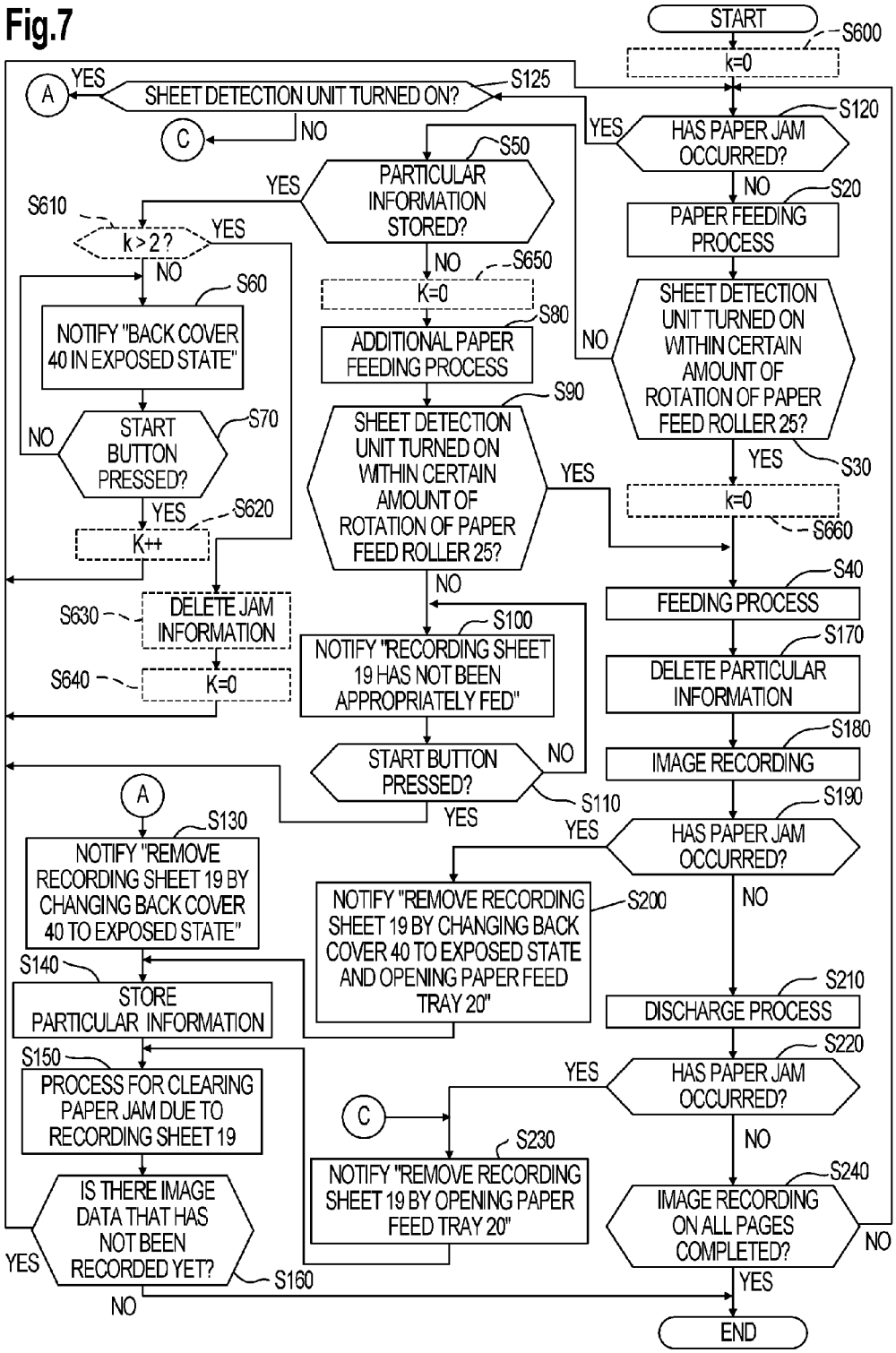
FIG. 7 is a flowchart depicting a recording control process according to a third embodiment of the invention.

Referring to FIG. 7, a process according to the fourth embodiment may comprise additional steps S600 to S660, as indicated by broken lines, to the flowchart of FIG. 4. The other steps may be substantially similar to the steps in FIG. 4.

When a command to execute the image recording is input from an external information device to the microcomputer 130, or to the microcomputer 130 by an operation performed on the operation panel 9, a count value k may be set to zero in step S600. The count value k may be the number of times the information indicating that the back cover 40 is in the exposed state is deleted from the liquid crystal display unit 11 by pressing the start button, e.g., the number of times the information is stopped. The count value k may be stored in a certain address of the RAM 133. That is, the RAM 133 may be an example of a number storage unit. As described above, when the start button is pressed, the information indicating that the back cover 40 is in the exposed state may be stopped. The start button may be operated to delete the information on the liquid crystal display unit 11 indicating that the back cover 40 is in the exposed state. The start button may be an example of an operation unit.

If it is judged in step S50 that the particular information is stored in the EEPROM 134, e.g., YES in step S50, the microcomputer 130 may judge whether the count value k is greater than two in step S610. If the count value k is less than or equal to two, e.g., NO in step S610, steps S60 and S70 may be executed, and the microcomputer 130 may increase the count value k by one in step S620. If the count value k is greater than two, e.g., the count value k is the third number of times, namely three, e.g., YES in step S610, the microcomputer 130 may delete the particular information from the EEPROM 134 in step S630, and may reset the count value k to zero in step S640.

If it is judged in step S50 that the particular information is not stored in the EEPROM 134, e.g., NO in step S50), too, the count value k may be reset to zero in step S650. Thus, if the start button is pressed three times in step S70, the particular information may be deleted from the EEPROM 134.

The processing in step S630 may be an example of a particular information control unit, an the processing in step S640 may be an example of a number delete control unit.

In the first, second, and third embodiments, the microcomputer 130 may not delete the particular information from the EEPROM 134 until the recording sheet 19 is detected by the sheet detection unit 110. In this case, the following problem may occur. If there is no recording sheet 19 in the paper feed tray 20 immediately after the back cover 40 that the user has forgotten to close is closed, the microcomputer 130 may incorrectly cause the liquid crystal display unit 11 to display information indicating that the back cover 40 is in the exposed state, although the recording sheet 19 has not been fed properly because there is no recording sheet 19 in the paper feed tray 20.

Therefore, according to the fourth embodiment, if the start button is pressed for the third certain number of times in order to stop the display of a message on the liquid crystal display unit 11, the microcomputer 130 may delete the particular information stored in the EEPROM 134. Therefore, the microcomputer 130 may cause the liquid crystal display unit 11 to display an appropriate message. According to the fourth modification, the microcomputer 130 may be prevented from causing the liquid crystal display unit 11 to display an incorrect message for multiple times.

Fifth Embodiment

In the fourth embodiment, the microcomputer 130 may delete the particular information from the EEPROM 134 in step S630 depicted in FIG. 7. Nevertheless, instead of deleting the particular information from the EEPROM 134, the microcomputer 130 may change the type of notification, such that the user of the multifunction device 1 may be notified that the recording sheet 19 has not been fed properly, in addition to the information indicating that the back cover 40 is in the exposed state, which is issued in step S60.

Figure 8:
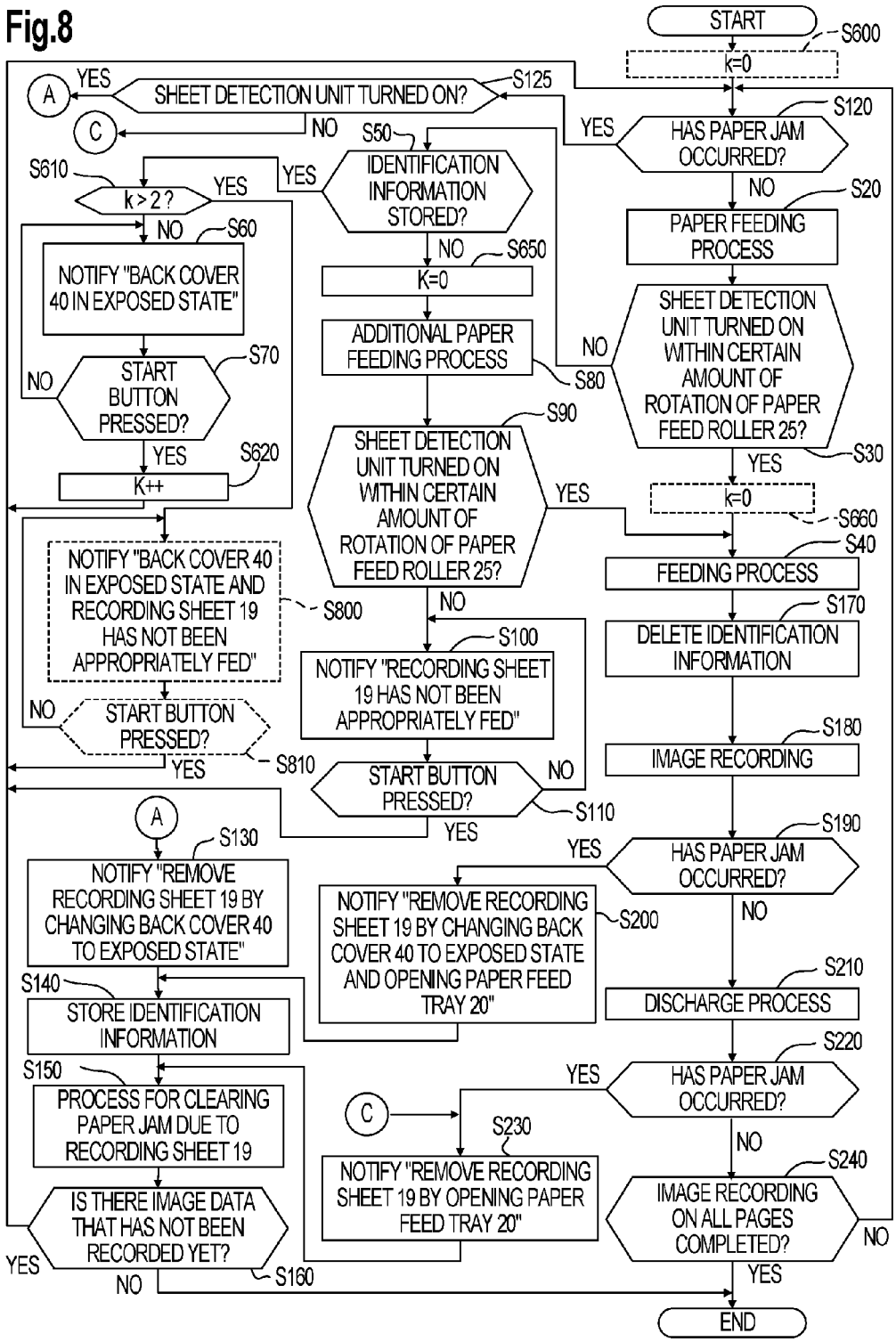
FIG. 8 is a flowchart depicting a recording control process according to a fourth embodiment of the invention.

Referring to FIG. 8, a process according to a fifth embodiment may comprise additional steps S800 and S810 indicated by broken lines instead of steps S630 and S640 in the flowchart of FIG. 7. Other steps of FIG. 8 may be substantially the same as the steps in FIG. 7.

If the count value k is greater than two, e.g., if the count value k is the third certain number of times, namely three, e.g., YES in step S610, the microcomputer 130 may notify the user of the multifunction device 1 that the back cover 40 is in the exposed state and the recording sheet 19 has not been fed properly in step S800. The microcomputer 130 may control the operation panel 9 to change a message displayed on the liquid crystal display unit 11 from the message depicted in FIG. 5A displayed in step S60 to the message depicted in FIG. 5G. The message depicted in FIG. 5G may remain displayed until the start button is pressed in accordance with the message, e.g., NO in step S810. If the start button is pressed, e.g., YES in step S810, a new recording sheet 19 may be fed from the paper feed tray 20 by the paper feed roller 25 in step S20 after the judgment as to whether a paper jam has occurred in step S120.

Thus, if the count value k stored in the RAM 133 is the third certain number of times or more, the microcomputer 130 may notify the user of the multifunction device 1 that the recording sheet 19 has not been fed properly, in addition to the information indicating that the back cover 40 is in the exposed state, which may be issued in step S60.

According to the fifth embodiment, if the information indicating that the back cover 40 is in the exposed state is displayed on the liquid crystal display unit 11 for the third certain number of times although the user has changed the state of the back cover 40 to the closed state in accordance with the message displayed on the liquid crystal display unit 11, the microcomputer 130 may cause the liquid crystal display unit 11 to display the message indicating that the recording sheet 19 has not been fed properly, in addition to the information indicating that the back cover 40 is in the exposed state. Therefore, the user may correct the problem that the recording sheet 19 has not been fed properly.

Sixth Embodiment

The certain amount of rotation may be constant. In the sixth embodiment, the certain amount of rotation may vary depending on the situation. For example, when the certain amount of rotation is relevant, e.g., in steps S30, S90, and S440, the certain amount of rotation may vary depending on whether the particular information is stored in the EEPROM 134.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A feeding apparatus comprising:

a tray configured to store a recording medium;

a feeding device configured feed the recording medium from the tray to a feed path;

a guide member disposed along the feed path and configured to selectively move between a first position, in which the guide member exposes the feed path, and a second position, in which the guide member covers the feed path and guides the recording medium through the feed path;

a first detection device disposed along the feed path downstream from the guide member, and configured to detect the recording medium fed in the feed path;

a second detection device configured to detect an amount of feeding implemented by the feeding device;

a judgment device configured to judge whether a feeding error has occurred in the feed path;

a memory configured to store particular information;

a particular information control device configured to store the particular information in the memory when the judgment device judges that a feeding error has previously occurred in the feed path, and configured to delete the particular information from the memory when the recording medium is detected by the first detection device; and a notification device configured to:

issue information indicating that the recording medium has not been fed from the tray to the feed path in response to the first detection device not detecting the recording medium by the time the second detection device detects that the amount of feeding of the feeding device since the recording medium began being fed has reached a first predetermined amount of feeding and when the memory does not store the particular information, and issue information indicating that the guide member is in the first position in response to the first detection device not detecting the recording medium by the time the second detection device detects that the amount of feeding of the feeding device since the recording medium began being fed has reached a second predetermined amount of feeding and when the memory stores the particular information.

2. The feeding apparatus according to claim 1, further comprising a supporting member configured to support the guide member, such that the guide member selectively moves between the first position and the second position.

3. The feeding apparatus according to claim 2, wherein the supporting member comprises a shaft and the guide member is pivotally mounted on the shaft, such that the guide member is configured to pivot about the shaft.

4. The feeding apparatus according to claim 1, wherein the guide member is separated from the feeding apparatus in the first position and is attached to the feeding apparatus in the second position.

5. The feeding apparatus according to claim 1, further comprising:

a feed control device configured to control the feeding device to execute an additional feeding process of the recording medium from the tray to the feed path in response to the first detection device not detecting the recording medium by the time the second detection device detects that the amount of feeding of the feeding device since the recording medium began being fed has reached a third predetermined amount of feeding and when the memory does not store the particular information, wherein the notification device is configured to issue the information after the feeding device executes the additional feeding process of the recording medium.

6. The feeding apparatus according to claim 5, wherein the feed control device is configured to:

control the feeding device to execute the additional feeding process of the recording medium from the tray to the feed path for a first predetermined number of times in response to the first detection device not detecting the recording medium by the time the second detection device detects that the amount of feeding of the feeding device since the recording medium began being fed has reached a fourth predetermined amount of feeding and when the memory does not store the particular information, and cause the feeding device to execute the additional feeding process of the recording medium from the tray to the feed path for a second predetermined number of times in response to the first detection device not detecting the recording medium by the time the second detection device detects that the amount of feeding of the feeding device since the recording medium began being fed has reached a fifth predetermined amount of feeding and when the memory stores the particular information, and wherein the first predetermined number of times is greater than the second predetermined number of times.

7. The feeding apparatus according to claim 1, further comprising:

an identification device configured to identify a position of the feeding error in the feed path, wherein the particular information control device is configured to store the particular information in the memory based on the position of the feeding error in the feed path identified by the identification device.

8. The feeding apparatus according to claim 1, further comprising:

an operation device configured to receive an instruction to stop the notification device from issuing the information indicating that the guide member is in the first position;

a number storage configured to store a number of times the notification device is stopped from issuing the information indicating that the guide member is in the first position; and a number delete control device configured to delete the number of times stored in the number storage when the particular information stored in the memory is deleted by the particular information control device, wherein the particular information control device is configured to delete the particular information from the memory when the number of times stored in the number storage unit is equal to or greater than a third predetermined number of times.

9. The feeding apparatus according to claim 1, further comprising:

an operation device configured to receive an instruction to stop the notification device from issuing the information indicating that the guide member is in the first position;

a number storage configured to store a number of times the notification device is stopped from issuing the information indicating that the guide member is in the first position; and a number delete control device configured to delete the number of times stored in the number storage when the particular information stored in the memory is deleted by the particular information control device, wherein the notification device is configured to issue information indicating that the recording medium has not been appropriately fed in addition to the information indicating that the guide member is in the first position when the number of times stored in the number storage unit is equal to or greater than a third predetermined number of times.

10. The feeding apparatus according to claim 1, wherein the first predetermined amount of feeding corresponds to the second predetermined amount of feeding.

11. The feeding apparatus according to claim 1, wherein the first predetermined amount of feeding is different from the second predetermined amount of feeding.

* * * * *